United States Patent [19]

Beyl

[11] 4,245,409

[45] Jan. 20, 1981

[54] SKI BOOT

[75] Inventor: Jean J. A. Beyl, Nevers, France

[73] Assignee: Look, S.A., Nevers, France

[21] Appl. No.: 962,185

[22] Filed: Nov. 20, 1978

[30] Foreign Application Priority Data

Dec. 2, 1977 [FR] France ..... 77 36281

[51] Int. Cl.[3] ..... A43B 5/04; A43B 13/14

[52] U.S. Cl. ..... 36/117; 36/31

[58] Field of Search ..... 36/117, 118, 119, 120, 36/121, 25 R, 31, 132

[56] References Cited

U.S. PATENT DOCUMENTS

| | | | |
|---|---|---|---|
| 3,665,620 | 5/1972 | St. Clair | 36/117 |
| 3,925,911 | 12/1975 | Erlebach | 36/117 |
| 3,955,825 | 5/1976 | Kubelka et al. | 36/117 |
| 3,957,280 | 5/1976 | Turnheim et al. | 36/117 |
| 4,000,567 | 1/1977 | Salomon | 36/117 |

FOREIGN PATENT DOCUMENTS

| | | | |
|---|---|---|---|
| 2746052 | 4/1979 | Fed. Rep. of Germany | 36/132 |

*Primary Examiner*—Patrick D. Lawson

*Attorney, Agent, or Firm*—Bierman & Bierman

[57] ABSTRACT

This ski boot is intended for properly and automatically positioning same on the ski without any preliminary adjustment of the safety binding in the longitudinal direction, irrespective of the boot size. The boot comprises a sole truncated at either end so as to provide a ski-engaging bottom bearing surface having a constant length independent of the boot size, the middle point of the sole being adapted to register with a reference mark carried by the ski; the end faces of the truncated sole are provided with recesses, cavities, grooves or projections adapted to co-operate with corresponding elements of the toe-end and heel-end devices of the safety binding.

16 Claims, 23 Drawing Figures

SKI BOOT

BACKGROUND OF THE INVENTION

1. Field of the Invention

The present invention is directed to an improved ski boot and complementarily to an assembly comprising this ski boot and the safety ski binding associated therewith.

2. Description of the Prior Art

Various types of ski boots are already known which are characterized by specific shortcomings. Thus, with conventional ski boots, comprising a sole extending from the toe end to the heel of the boot, which are used with a front abutment device and a heel hold-down device, it is relatively difficult for the skier to walk without the skis. Moreover, when a change in the boot size is necessary the front and rear safety ski binding devices must be readjusted in the longitudinal direction, and this constitutes a tedious constraint.

Another known type of ski boot comprises lateral elements adapted to engage matching lateral means of the safety ski bindings, as disclosed for example in the U.S. Pat. No. 3,578,349. One advantage resulting from this specific type of ski boot is that it is unnecessary to adjust the position of the front device and of the heel hold-down device; however, the same ski boot is objectionable in that the boot is not properly held on the ski, so that the skier's safety is more or less jeopardized.

In a third known ski boot design the boot sole comprises cavities or recesses engageable by retaining members of the bindings. Boots of this type are described in the U.S. Pat. No. 3,061,325 and also in the German Patent Application No. 2,359,309. These boots are likewise advantageous in that they make it possible to avoid the necessity of adjusting the safety ski bindings in the longitudinal direction, but unfortunately they are objectionable in that snow or ice tends to accumulate in the sole cavities intended for receiving the binding's elements, so that it is frequently difficult if not impossible to fit the boot properly on the ski.

Another known proposition is disclosed in the German Patent Application No. 2,308,535 concerning ski boots of which the rear portion of the sole is truncated in such a manner that a binding can be inserted under the heel, the mechanism of this binding being adapted to engage the corresponding end surface of the sole. The purpose of this particular arrangement is to improve the resistance of the safety ski binding to lateral stress, which notoriously has its maximum value in the rear third of the boot sole.

However, with the device it is not possible to dispense with the longitudinal adjustment of the ski bindings when changing from one boot size to another.

Finally, a ski boot structure is depicted in the French Pat. No. 2,092,519 wherein the toe and heel ends of the sole engage the front or abutment and rear or heel hold-down devices of the safety binding, respectively, so that the boot is so to say suspended over the ski surface. The scope of this device is to facilitate the slipping of the boot when it is necessary to release it from the binding, but also in this case a preliminary adjustment of the safety binding in the longitudinal direction is also necessary when changing from one boot size to another.

SUMMARY OF THE INVENTION

It is the primary object of the present invention to avoid the inconveniences of prior art devices as broadly mentioned hereinabove, while preserving the advantageous features of the various hitherto known ski boot types.

To this end, the ski boot according to the present invention comprises a sole truncated at its front and rear ends, so as to provide a ski- or ground-engaging surface having a constant length irrespective of the boot size.

The front and rear devices of the ski binding being so disposed that the distance therebetween corresponds to the constant length of the truncated sole, it is clear that with this arrangement it is no more necessary to adjust the length of the ski binding when changing the boot size.

According to a typical form of embodiment of this invention, the distances between the front and rear ends of the truncated sole, on the one hand, and the middle point of the sole, on the other hand, are constant. More particularly, these distances may be equal to each other, the middle point of the sole corresponding in this case to the middle point of the boot and registering necessarily with a reference mark provided on the ski for showing the position of the middle point of the boot when the latter is fitted to the ski binding.

According to another specific feature characterizing this invention, the front and rear ends of the truncated sole are shaped to facilitate their engagement with binding elements carried by the ski, in order to retain the boot on the ski.

Thus, the front and rear ends of the truncated sole may be provided with recesses or grooves adapted to be engaged by matching retaining members forming an integral part of the toe and heel binding devices.

Other features and advantages of the present invention will appear as the following description proceeds with reference to the accompanying drawings illustrating diagrammatically by way of example several forms of embodiment of the ski boot according to this invention.

DESCRIPTION OF THE PREFERRED EMBODIMENTS

Figure 1:
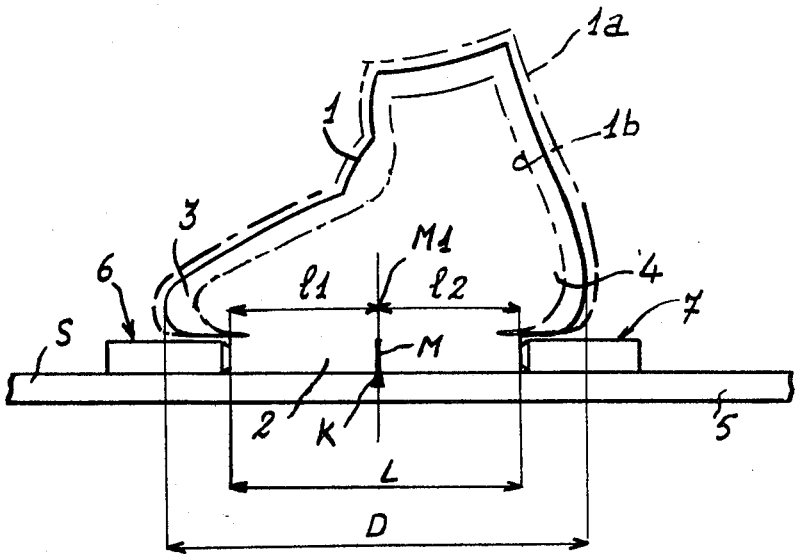
FIG. 1 is a diagrammatic side elevational view illustrating the basic principle of a ski boot according to this invention which is engaged on the ski top between the toe and heel devices of the safety ski binding.

In the form of embodiment illustrated in FIGS. 1 to 5 and 18, 19, the ski boot 1 comprises, according to the basic principle of the present invention, a sole 2 truncated at its front and rear ends in such a way that free spaces are obtained under the toe end 3 and the heel end 4 of the boot. The truncated sole 2 having a length L shorter than the length D of the boot 1 comprises complementarily a bearing surface engaging the ski 5 along a constant length L independent of the boot size.

The position of the sole 2 may vary with respect to the other boot portions; thus, the sole 2 may be shifted somewhat towards the toe end 3 or towards the heel end 4, and the distances between the front and rear end of this truncated sole 2, on the one hand, and the middle point M1 of the boot, on the other hand, may vary, but not as a function of the boot size. In the form of embodiment described herein, the distances 11, 12 between the front and rear ends of the truncated sole 2 and the middle point M1 of the boot 1 are constant and preferably equal to each other. Consequently, $l1=l2=L$. The length L of the truncated sole 2 remains constant irrespective of the boot size. Thus, there is shown in phantom lines, in FIG. 1, a boot 1*a* of a size greater than that of boot 1 but provided with the same truncated sole 2, and also another boot 1*b* of a smaller size but having a length only slightly greater than the length L of the truncated sole 2.

A boot such as 1, 1*a* or 1*b* is fitted as follows; Firstly, the front or toe end device 6 of the safety ski binding is secured to the ski surface, whereafter the heel hold-down device 7 of the binding is secured so that the distance between the two devices be slightly greater than L, on either side of a reference mark K formed on the ski, the middle point M of the boot corresponding normally to this reference mark K. Thus, it is only necessary to insert between the devices 6 and 7 of the ski binding a ski boot of any desired size, provided with the truncated sole 2 having a length L, and the boot will position itself automatically on the ski 5, with the middle point M of the sole registering with the reference mark K on the ski. Preferably but not compulsorily, the middle point M1 of the boot should correspond to the middle point M of the sole 2, so that the three points K, M and M1 are aligned with each other.

The front and rear ends of the sole 2 and possibly the toe and heel ends (3, 4) of the ski boot are shaped for co-operating with the binding devices 6 and 7 secured to the ski 5, in order to retain the boot on the ski. In the form of embodiment illustrated in FIGS. 2 to 5 and 18–19, each end of the truncated sole 2 comprises a recess, cavity or groove 8 adapted to be engaged by a corresponding retaining or locking member 9 of the holding jaw 11 of the relevant device 6 or 7 of the ski binding. This locking member 9 is preferably formed integrally with the jaw 11. More particularly, each cavity 8 extends across the full width of the relevant end of the sole 2, and has a curved profile (a convex profile in the example illustrated), the locking member 9 being introduced into this recess or groove 8 for holding the ski boot on the ski 5.

Figure 5:
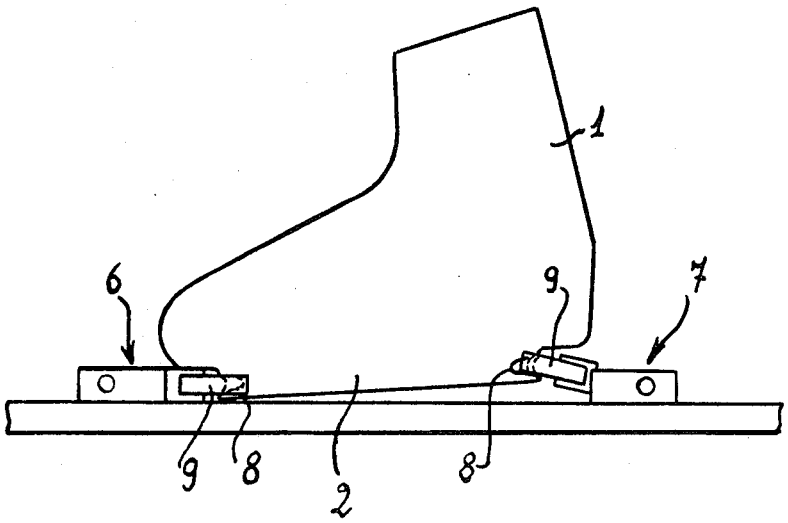
FIG. 5 is a view similar to FIG. 2 showing the position of the ski boot at the beginning of a forward fall.
Figure 2:
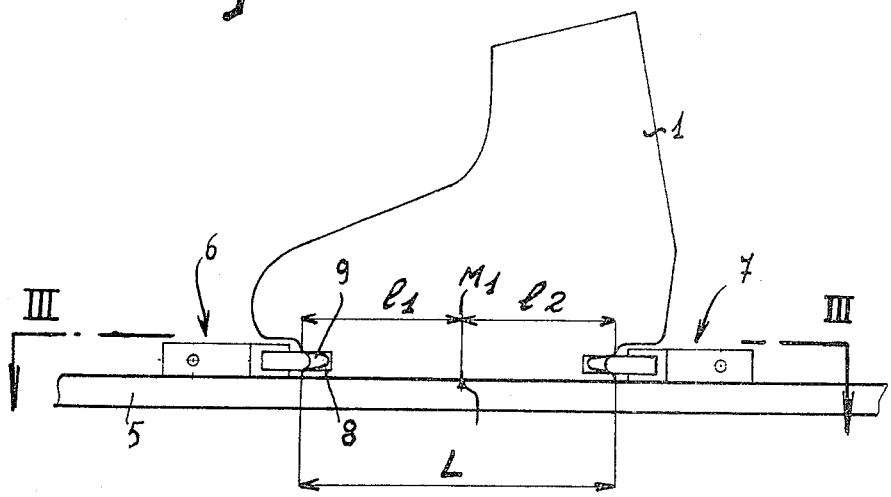
FIG. 2 is a side elevational view showing a first form of embodiment of the ski boot of this invention, wherein the front and rear ends of the truncated sole are provided with curved grooves or notches.
Figure 3:
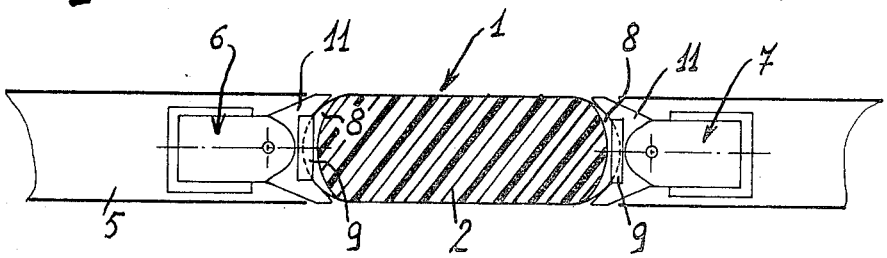
FIG. 3 is a plane view from above and a half-section taken along the line III—III of FIG. 2.
Figure 4:
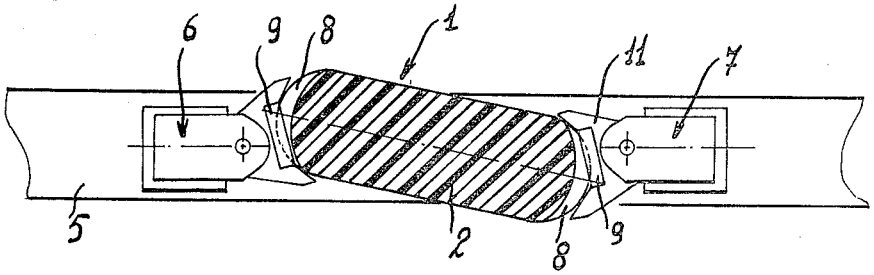
FIG. 4 is a view similar to FIG. 3 showing the ski boot partially released from the binding as a consequence of a torsional movement of the skier's leg.

Each ski binding device 6, 7 provides the requisite safety action against torisional efforts and also in case of fall in a vertical plane. FIG. 4 illustrates the position of the ski boot 1 and of the devices 6 and 7 of the ski binding at the beginning of the release movement in case of torsion stress, and FIG. 5 shows the position of the boot at the beginning of a forward fall, the locking member 9 of the heel hold-down device 7 beginning to pivot about an axis perpendicular to the longitudinal center line of the ski.

With the assembly also contemplated by the present invention, which comprises in combination a ski boot 1 or 1*a* and toe and heel devices 6, 7 of the ski binding, it is possible to properly position the boot with respect to the reference mark K on ski 5, independently of the boot size, without requiring any adjustment of the ski binding in the longitudinal direction. Moreover, the boot of this invention is held very safely on the ski 5, since it is positively locked thereto, in contrast to some known prior art constructions. In addition, the risk of snow or ice accumulating at the ends of the truncated sole 2 is reduced considerably. In fact, contrary to some known devices mentioned in the foregoing, the spaces provided between the truncated ends of the sole 2 and the toe and heel ends 3, 4 of the boot 1 have only two possible inlets (instead of three) for the snow, so that any snow penetrating therein can scarely be retained.

Figure 6:
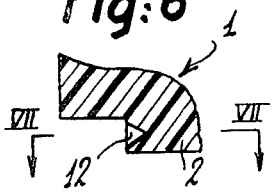
FIGS. 6, 7; 8, 9; 10, 11; 12, 13; 14, 15; 16, 17 and 18, 19 illustrate on a larger scale fragmentary sections of seven different forms of embodiment of the recesses or grooves formed at a front or rear end of the truncated sole of the ski boot, the modified version of FIGS. 18 and 19 corresponding to the form of embodiment illustrated in FIGS. 1 to 5 of the drawings.
Figure 7:
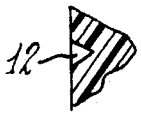

In the modified form of embodiment illustrated in FIGS. 6 and 7, the front or rear end of the truncated sole 2 is simply provided with a central notch or cavity 12 having a triangular cross-section, adapted to co-operate with a corresponding projection or lock bolt of the binding member associated therewith.

Figure 8:
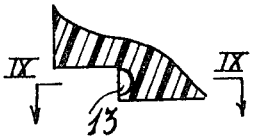
Figure 10:
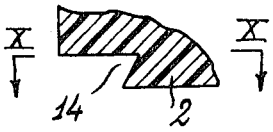
Figure 9:
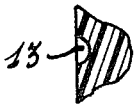
Figure 11:
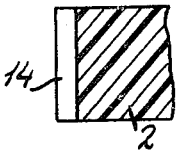
Figure 12:
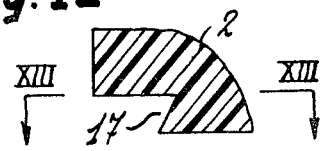

FIGS. 8 and 9 show a central semi-circular sectioned notch 13 and FIGS. 10 and 11 show a modified version in which the cavity 14 extends across the full width of the sole 2, with a rectilinear contour.

Figure 14:
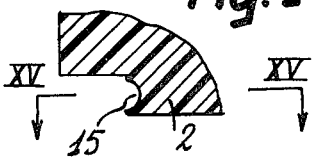
Figure 13:
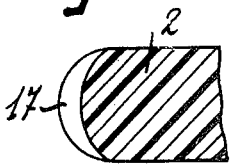
Figure 15:
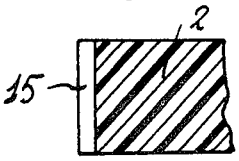
Figure 16:
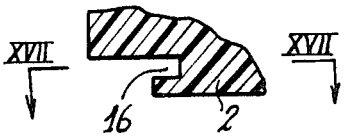
Figure 18:
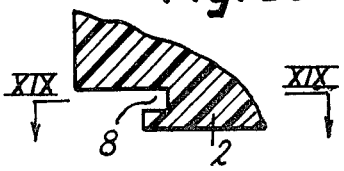
Figure 17:
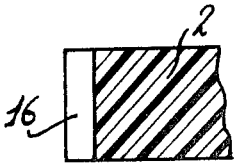
Figure 19:
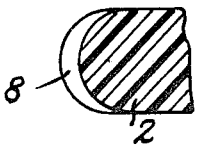

In the form of embodiment shown in FIGS. 14 and 15, the rectilinear recess 15 has a semi-circular cross-section and in the modified version of FIGS. 16 and 17 the rectilinear cavity 16 is of channel configuration. The modified embodiment of FIGS. 18 and 19 departs from that of FIGS. 16 and 17 in that the cavity 8 has a convex profile.

Figure 20:
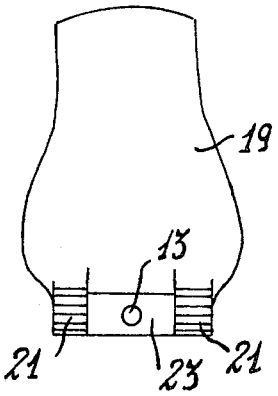
FIGS. 20 and 21 illustrate an eighth form of embodiment of the ski boot according to this invention, shown in elevation as seen from the rear and in side elevational view, respectively.
Figure 21:
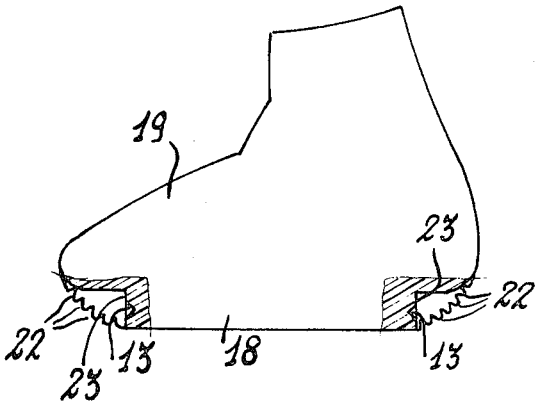

FIGS. 20 and 21 illustrate another possible form of embodiment of the ski boot of this invention. In this ski boot the ends of the truncated sole 18 are connected to the toe and heel ends of the boot 19, respectively, by means of curved portions 21 provided with transverse or horizontal corrugations or teeth 22. These curved portions 21 consists of pairs of lateral lugs disposed at the ends of the sole 18, on either side of the end faces 23 of the sole.

When the skier wearing the ski boots of this invention has to walk, his gait is greatly facilitated by the presence of the corrugated or toothed lugs 21 of which the corrugations or teeth 22 prevent the boot from slipping on snow or icy surfaces.

Figure 22:
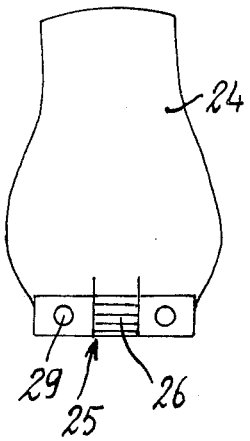
FIGS. 22 and 23 are views similar to FIGS. 20 and 21, showing a ninth form of embodiment of the ski boot.
Figure 23:
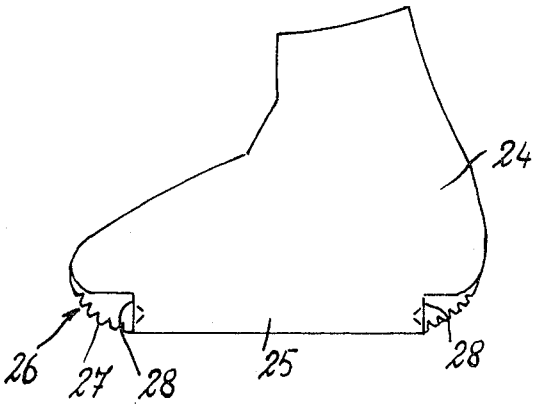

The modified form of embodiment illustrated in FIGS. 22 and 23 differs from the one shown in FIGS. 20 and 21 in that the boot 24 comprises only a curved portion at either end of the sole 25 consisting of a central longitudinal lug 26 also formed preferably with corrugations or anti-skid teeths 27 similar to the teeth 22 of the preceding form of embodiment. The end faces 28 of this sole 25 extend on either side of the central lugs 26 and are somewhat recessed in relation thereto, each portion of said faces 28 having a circular hole 29 formed therein for receiving a matching lock bolt pertaining to the corresponding safety binding device 6 or 7.

The length L of the truncated sole differs according as the boot is of a size intended for adults or children. Thus, a predetermined length $L_1$ may be contemplated for a range of children's boot sizes, and another length $L_2$ greater than $L_1$ may be contemplated for another range of adults' boot sizes.

This invention should not be construed as being strictly limited by the various forms of embodiment shown and described herein, since many other modifications may be brought thereto without departing from the basic principle of the invention. Thus, given a same truncated sole, the front and rear faces may differ from each other. They may notably have projections in lieu of cavities, these projections being adapted to engage matching cavities formed in the corresponding safety binding elements.

What is claimed as new is:

1. A ski boot for detachable engagement with a ski, said ski boot comprising: a sole unitarily and non-detachably disposed on said boot and truncated at its front and rear ends so as to provide a bottom bearing surface having a constant length irrespective of the boot size, whereby said bottom bearing surface is adapted for direct contact alternatively with the ground and with the ski.

2. A ski boot as claimed in claim 1, wherein the distances between the front and rear ends of the truncated sole, on the one hand, and the middle point of the boot, on the other hand, are constant.

3. A ski boot as claimed in claim 2, wherein the distances between the front and rear ends of the truncated sole, on the one hand, and the middle point of the boot, on the other hand, are equal, said middle point being intended for registering with a reference mark carried by the ski.

4. A ski boot as claimed in claim 3, wherein the front and rear ends of said truncated sole are provided with means adapted to co-operate with matching members of safety binding devices secured to the ski surface for retaining the ski boot in position.

5. A ski boot as claimed in claim 4, wherein said means provided at the front and rear ends of said truncated sole consist of recesses adapted to be engaged by matching boot-retaining elements of the corresponding boot-engaging devices of the safety ski binding.

6. A ski boot as claimed in claim 5, wherein said recesses are notches formed in the central portions of the front and rear ends of said truncated sole.

7. A ski boot as claimed in claim 5, wherein said recesses extend across at least one portion of the width of the end faces of said truncated sole, and have a rectilinear profile adapted to co-operate with matching retaining means of the ski binding devices at the toe and heel ends of the boot, respectively.

8. A ski boot as claimed in claim 5, wherein said recesses extend across at least one portion of the width of the end faces of said truncated sole, and have a curvilinear profile adapted to co-operate with matching retaining means of the ski binding devices at the toe and heel ends of the boot, respectively.

9. A ski boot as claimed in claim 7, wherein the end faces of the truncated sole are connected to the toe and heel ends of the boot, respectively, by means of curved portions adapted to facilitate the skier's walk and provided preferably with anti-ski corrugations.

10. A ski boot as claimed in claim 8, wherein the end faces of the truncated sole are connected to the toe and heel ends of the boot, respectively, by means of curved portions adapted to facilitate the skier's walk and provided preferably with anti-ski corrugations.

11. A ski boot as claimed in claim 9, wherein said curved portions consist of lateral lugs, each end of the truncated sole comprising two such lugs.

12. A ski boot as claimed in claim 10, wherein said curved portions consist of lateral lugs, each end of the truncated sole comprising two such lugs.

13. A ski boot as claimed in claim 9, wherein said curved portions consist of central lugs, said end faces being disposed on either side of the relevant central lug.

14. A ski boot as claimed in claim 10, wherein said curved portions consist central lugs, said end faces being disposed on either side of the relevant central lug.

15. A ski boot and safety ski binding assembly comprising a boot as claimed in claim 13 and a safety ski binding provided with a retaining member adapted to be engaged under the corresponding end of the boot and to co-operate with the corresponding end of said truncated sole for fastening the boot to the ski.

16. A ski boot and safety binding assembly comprising a boot as claimed in claim 14 and a safety ski binding provided with a retaining member adapted to be engaged under the corresponding end of the boot and to co-operate with the corresponding end of said truncated sole for fastening the boot to the ski.

* * * * *